US011414860B2

(12) United States Patent
Jungbauer

(10) Patent No.: US 11,414,860 B2
(45) Date of Patent: Aug. 16, 2022

(54) DISMANTLABLE ANECHOIC CHAMBER

(71) Applicant: Guillermo Ramon Alejandro Jungbauer, Barcelona (ES)

(72) Inventor: Guillermo Ramon Alejandro Jungbauer, Barcelona (ES)

( * ) Notice: Subject to any disclaimer, the term of this patent is extended or adjusted under 35 U.S.C. 154(b) by 1054 days.

(21) Appl. No.: 16/037,556

(22) Filed: Jul. 17, 2018

(65) Prior Publication Data

US 2019/0017265 A1 Jan. 17, 2019

(30) Foreign Application Priority Data

Jul. 17, 2017 (EP) ..... 17382467

(51) Int. Cl.

| | |
|---|---|
| ***E04B 1/99*** | (2006.01) |
| ***G10K 11/168*** | (2006.01) |
| ***E04B 2/74*** | (2006.01) |
| ***E04B 1/82*** | (2006.01) |
| ***E04B 1/61*** | (2006.01) |

(52) U.S. Cl.

CPC ..... *E04B 1/99* (2013.01); *E04B 1/8218* (2013.01); *E04B 2/7403* (2013.01); *G10K 11/168* (2013.01); *E04B 1/6145* (2013.01); *E04B 2002/7487* (2013.01)

(58) Field of Classification Search

CPC ..... E04B 1/99; E04B 1/8218; E04B 2/7403; E04B 1/6145; E04B 2002/7487; E04B 1/6154; E04B 1/6158; G10K 11/168

USPC ..... 181/198

See application file for complete search history.

(56) References Cited

U.S. PATENT DOCUMENTS 5,141,073 A * 8/1992 Pelonis ..... E04B 1/8209 181/295
5,210,984 A * 5/1993 Eckel ..... E04B 1/8218 52/265
5,239,792 A * 8/1993 Avni ..... E04B 1/8218 52/171.3
5,525,765 A * 6/1996 Freiheit ..... E04B 1/8218 181/30

(Continued)

FOREIGN PATENT DOCUMENTS

EP 2481868 A1 8/2012
EP 2837749 A1 * 2/2015 ..... E04B 1/14

(Continued)

OTHER PUBLICATIONS

Extended European Search Report for Application No. 17382467.3, dated Jan. 4, 2018 in 7 pages.

*Primary Examiner* — Jeremy A Luks
(74) *Attorney, Agent, or Firm* — Knobbe, Martens, Olson & Bear, LLP

(57) ABSTRACT

A dismantlable anechoic chamber for sound attenuation includes a number of interconnected panels. The panels have a groove around their edges. The spaces produced by the corresponding grooves at contacting edges of adjacent panels are occupied by battens. The panels have a sandwich-type structure, in which a layer of sound-attenuating material is positioned between the two main faces of the panel. There is dimensional interference between the battens and the panels. The chamber has, on its internal face, an additional sound-attenuating layer. This sound-attenuating material is a foam-like material. The batten has an intermediate layer of sound-attenuating foam material.

9 Claims, 15 Drawing Sheets

(56) References Cited

U.S. PATENT DOCUMENTS

| | | | | |
|---|---|---|---|---|
| 5,813,180 | A | 9/1998 | Whitney et al. | |
| 6,073,722 | A * | 6/2000 | Babuke | E04B 1/8209 181/290 |
| 8,083,023 | B1 * | 12/2011 | Perdue | E04B 1/8218 181/198 |
| 10,370,847 | B2 * | 8/2019 | Caffaratti Giro | E04H 1/12 |
| 2018/0298600 | A1 * | 10/2018 | Moss | E04C 2/388 |

FOREIGN PATENT DOCUMENTS

| | | | | |
|---|---|---|---|---|
| FR | 2425009 | A1 | 11/1979 | |
| GB | 2428696 | A | 2/2007 | |
| GB | 2562310 | A * | 11/2018 | E04B 1/8218 |

* cited by examiner

DISMANTLABLE ANECHOIC CHAMBER

FIELD OF THE INVENTION

The present invention relates to a dismantlable anechoic chamber, i.e. to a dismantlable acoustic chamber designed for significantly attenuating the sound produced in the inside thereof.

BACKGROUND OF THE INVENTION

Said type of chamber is used, for example, by musicians so they can rehearse in their homes without disturbing their neighbours. The chamber is assembled in one room of the home and can be dismantled when the inhabitants move house.

The ability of said chambers to be moved to different places causes construction problems because, in order to be able to install them in homes, it is necessary to "break" the chamber into prefabricated pieces that can fit through the door or windows of a house. However, reducing the size of the prefabricated pieces is a problem because the gaps therebetween have paths for the sound which can diminish the soundproofing properties of the chamber, and connecting the panels anechoically in situ is also difficult. The patent documents U.S. Pat. No. 5,210,984 and CN201169830 disclose acoustic chambers, the panels of which have complex metal structures having actuable mechanical closures for covering the joints between panels from the outside. Likewise, the panels have large dimensions (they cover the entire height or width of the chamber) in order to eliminate, as far as possible, the joints between panels, which joints form an escape route for the sound.

The patent document FR2425009 relates to thermal cladding for walls. Unlike the wall of a dismantlable anechoic chamber, the cladding in FR2425009 does not have to have a structural function. The thermal cladding and acoustic cladding are not equivalent and their construction constraints are different, it being necessary in particular to avoid bridges of different topologies in both cases, so this document is not part of the prior art of the present invention, nor would a person skilled in the art consider it in order to solve a problem related to sound insulation. The cladding has a plurality of sandwich-type panels and battens positioned between panels. Both the sandwich-type panels and the battens comprise a layer of foam-like thermal insulation material. FR 2425009 does not disclose dimensional interference between panels and battens, nor does it require such for its proper functioning. FR2425009 indicates that the thickness of the thermal insulation material for the panels and battens should be the same to prevent the existence of thermal bridges through which heat would preferably escape. In any case, the maximum difference in thickness between the layers of thermal insulation material disclosed by said document is 2-3 mm.

The patent document ES2365583 discloses a dismantlable anechoic chamber comprising a plurality of interconnected panels, panels in contact with one another comprising a groove around the entire perimeter of their edges, the spaces produced by the corresponding grooves at contacting edges of adjacent panels being occupied by battens. The battens have a thin layer of elastomer material for ensuring there is pressure between battens and panels, said pressure preventing air passing through from inside or outside the chamber or relative vibration between battens and panels. The elastomer material achieves this function without creating stiffness as a result of the stresses between the batten and panel, which stresses would act as a sound bridge through which the sound would be transmitted to the outside.

However, one problem linked with this solution is that the elastomer materials can deform over time, and that, once deformed, they also take a long time to return to a similar state to the initial one. As a result, after dismantling the chamber and reassembling it, the chamber loses some acoustic properties because of the semi-permanent deformation of the elastomer material. This is exacerbated if the chamber is dismantled in a careless manner, causing additional stresses in the elastomer material.

SUMMARY OF THE INVENTION

An object of the present invention is to disclose means for obtaining an anechoic chamber that is easily assembled and dismantled, is effective in attenuating the sound, and can be assembled and dismantled many times without significant loss of its sound attenuation properties.

In particular, the present invention discloses a dismantlable anechoic chamber for sound attenuation, comprising a plurality of interconnected panels, the panels having a groove around their edges, the spaces produced by the corresponding grooves at contacting edges of adjacent panels being occupied by battens, the panels having a sandwich-type structure in which a layer of sound-attenuating material is positioned between the two main faces of the panel and there being dimensional interference between battens and panels, the chamber having, on its inner face, an additional sound-attenuating layer, characterised in that the sound-attenuating material is a foam-like material and in that the batten has a layer of sound-attenuating foam material. According to the present invention, the thickness of the layer of the sound-attenuating foam material is preferably less, preferably at least 4 mm less, than said layer of sound-attenuating material of the panels. More preferably, said difference in thicknesses could be at least 7 mm, at least 10 mm and even more preferably at least 20 mm.

The present invention is able to replace the elastomer material by means of a combination of features. The sound-attenuating foam material not only performs the function of sound attenuation, but also, the air-filled cells in the foam material provide physical damping that replaces the elastomer material. Moreover, the difference in thicknesses between the sound-attenuating layer of the panels and of the battens ensures that the battens and panels behave sufficiently differently so as to produce the damping behaviour of the batten. This is particularly surprising since a first thought would be to avoid thicknesses having different attenuation in order to prevent there being sound bridges caused by different levels of stiffness in the wall of the anechoic chamber.

In a particularly preferred embodiment, the sound-attenuating material of both the panels and the battens is the same.

Another problem with the production of this type of element is achieving controlled dimensional interference between the panels and battens. The problem is even greater when materials comprising lignite materials, i.e. wood or wood-containing materials, are used. The present invention also discloses means for solving this problem. To do so, in the present invention, in a particularly preferred embodiment, said sound-attenuating materials of the panels and battens are a pre-pressed sound-attenuating foam material.

In combination with the different layer thicknesses, the pre-pressing allows the tight fit to be obtained in a simple and secure manner as a result of dimensional interference, since it causes slight permanent deformations of different sizes in the panels and the battens. The sound-attenuating material can undergo pre-pressing during the production process of the panels and battens. This makes it possible to design battens of which the nominal thickness (with no pre-pressing) is the same as the gap in the grooves. When pre-pressing is used, it is preferable (since it is convenient and secure) to use the same pre-pressing pressure for the panels and the battens, so as to ensure dimensional interference following pressing. As already mentioned, since the layers have different thicknesses, it is also ensured that the size of the slight permanent deformation caused by the pressing is different in both the panels and the battens.

According to another aspect of the present invention, the acoustic chamber has a damping layer in the interface between vertical battens. This prevents sounds being generated by vibration between vertical battens, something which is encouraged by gravity acting perpendicularly to the interface between said vertical battens.

When designing dismantlable anechoic chambers, the resolution of the corners is a particularly critical factor. The present invention also discloses a solution that is particularly advantageous and simple.

In particular, a corner panel according to the present invention, which comprises a layer of sound-attenuating material positioned between two panels, i.e. an inside panel and an outside panel, is such that, at least at one end, said layer projects beyond the inside panel, and the outside panel continues around the corresponding edge at the end of the layer projecting beyond the inside panel, in such a way that a space is produced between the end of the outside panel and the end of the inside panel, which space forms a groove for receiving one of said battens.

In addition to the anechoic chamber, battens and panels according to the present invention, the present invention also discloses a method for producing the components of the chamber, and in particular the panels and/or battens according to the present invention, said method comprising a step of pre-pressing said panels and/or battens. Preferably, the pre-pressing is carried out using the same pressure for the different components being pre-pressed.

BRIEF DESCRIPTION OF THE DRAWINGS

To better understand the invention, explanatory but non-limiting drawings of an embodiment of the present invention are included.

DETAILED DESCRIPTION OF THE PREFERRED EMBODIMENTS

Figure 1:
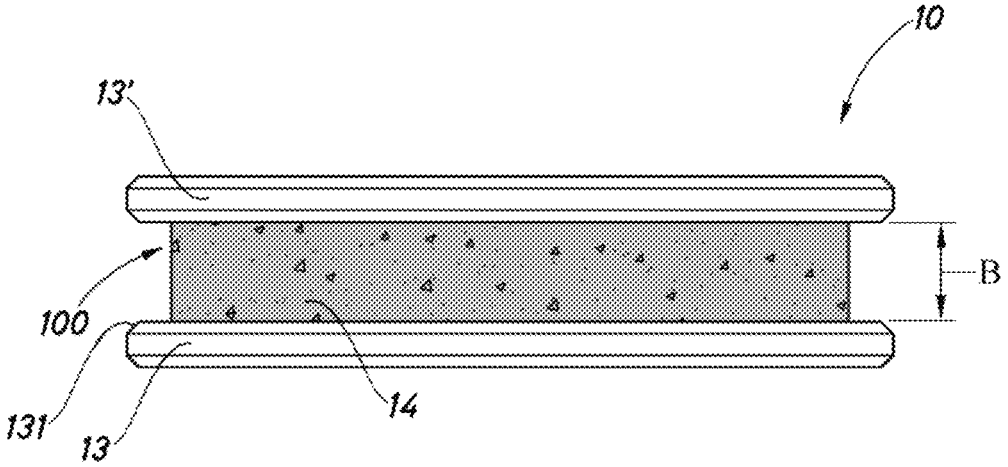
FIG. 1 is a view of a panel in which the edge thereof and its internal components can be seen.

FIG. 1 shows a planar panel -10- consisting of two sheets -13-, -13'- that have an outer surface coating and enclose a sound-insulating material -14- in a sandwich-like manner. The sound-insulating material -14- is a foam material. The surface area of the sheets -13-, -13'- is greater than the surface area covered by the sound-insulating material -14-, and therefore the panel leaves a groove -100- (in this case in the shape of a U) around the entire panel. The sheets and the sound-insulating material -14- can be connected using adhesive, for example. The groove -100- has a width -B- corresponding to the thickness of the sound-insulating material -14-.

The edges of the sheets -13-, -13'- have a chamfered finish -131- to aid the insertion of battens.

Figure 2:
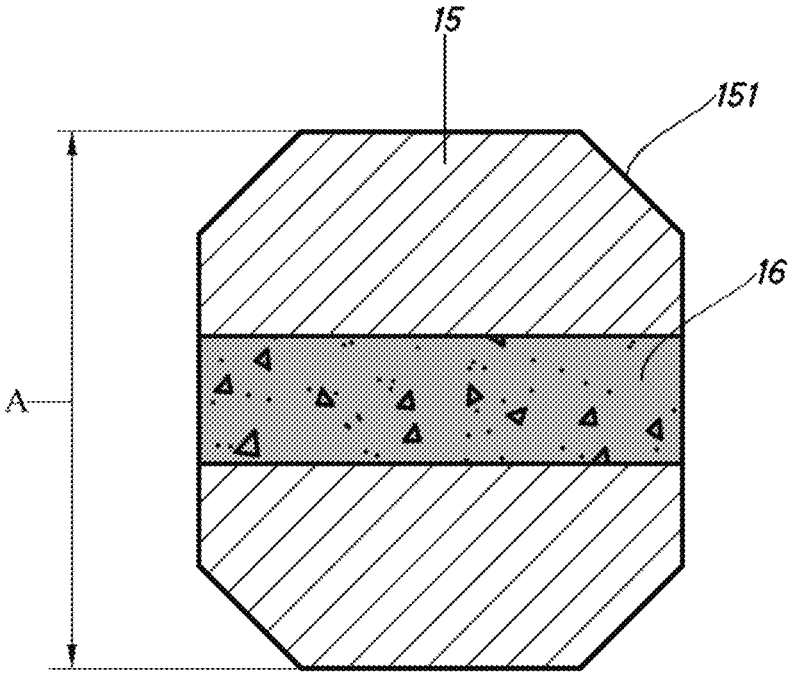
FIG. 2 is a cross section through an inter-panel batten that can be used in the chamber in the example.

FIG. 2 is a cross section of a batten -15-. The corners have a chamfer -151- to aid the insertion of the batten into the spaces produced by the grooves in the panels. The battens in the example are made of a lignite material, e.g. fibreboard, having an intermediate strip -16- of sound-insulating material, preferably the same material as the sound-insulating material of the panels in order to make it easier to fit the battens in the gaps produced by the grooves in the panels. The panel has sides having a length -B- that is slightly larger than the distance -A- available in the groove. This produces dimensional interference, which causes the foam material of the strip -16- to be compressed and exert a pressure against the walls of the panels, which pressure helps prevent sound being transmitted through the walls of the chamber. As can be seen, the thickness of the intermediate strip -16- is significantly less than the thickness of the sound-insulating material -14- of the panels. This difference may be advantageous for two reasons. Firstly, it ensures that the tight fit is mainly achieved by means of compression of the intermediate strip -16- and not by means of traction on the sound-insulting material -14- of the panels, which is undesirable. In addition, the difference in the thicknesses of the material of the battens and panels provides a simple and reliable means of achieving the dimensional interference, which involves pre-pressing the battens and the panels during or after their production process by subjecting the material to a certain pressure (preferably the same pressure for both components). Said pressure produces a slight deformation in the foam material, possibly associated with the collapse or rupture of cells in the material. The deformation percentage depends on the pressure, so the thickness of the thicker foam material (i.e. the material corresponding to the panel) varies more than the thinner material (i.e. the material corresponding to the batten). This makes it possible to produce battens having a nominal length equal to that of the groove in the panels. After pre-pressing, a dimensional interference is produced which ensures the tight fit. The pre-pressing also ensures that the sound-insulating material of the panels is not stretched beyond its nominal length, which is undesirable.

The length of the battens -15- can be variable, depending on the point in the chamber -1- they occupy, provided that, when assembled, the battens occupy the spaces produced by grooves -100- in adjacent panels.

Figure 3:
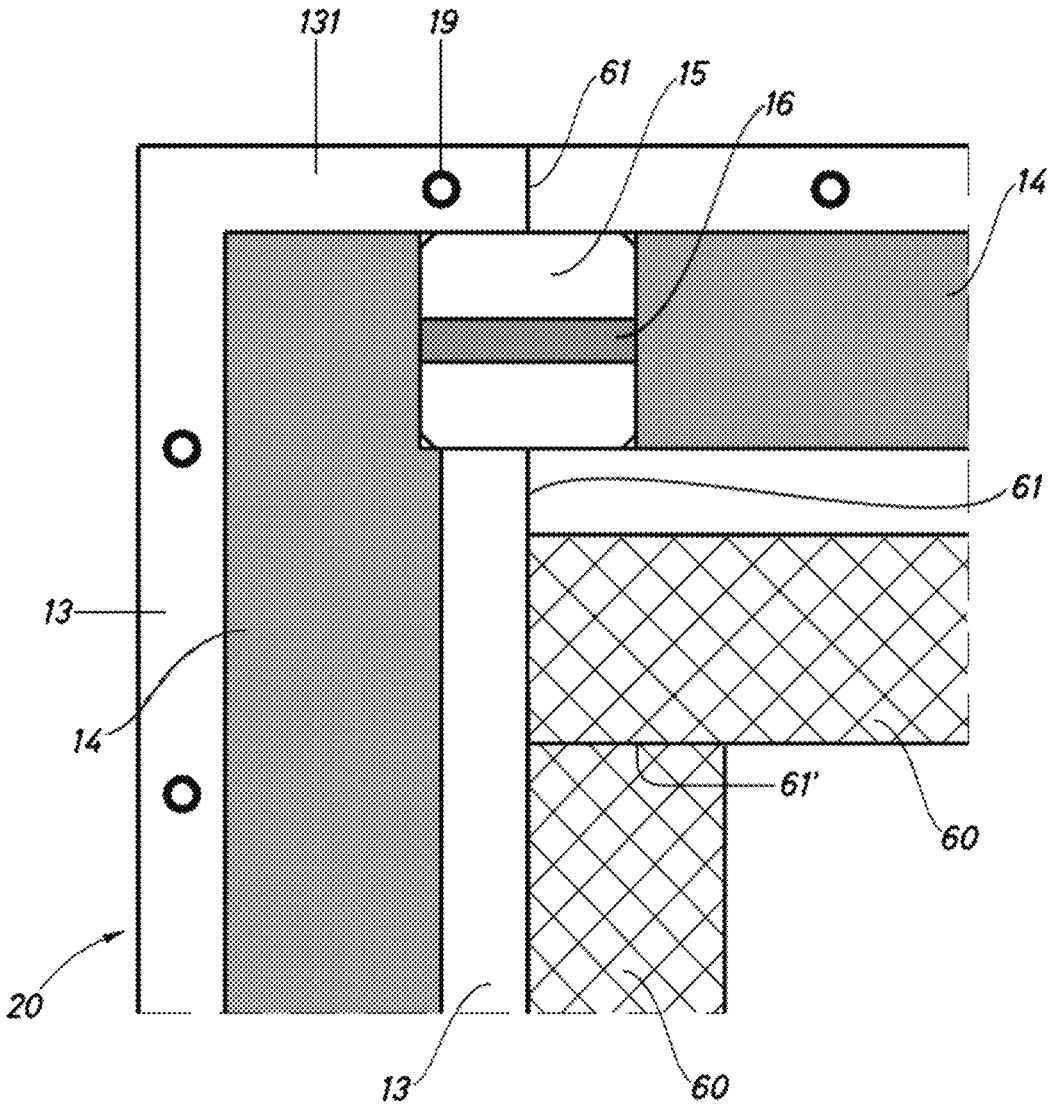
FIG. 3 is a top view of the arrangement of a corner of an anechoic chamber according to the present invention.
Figure 4:
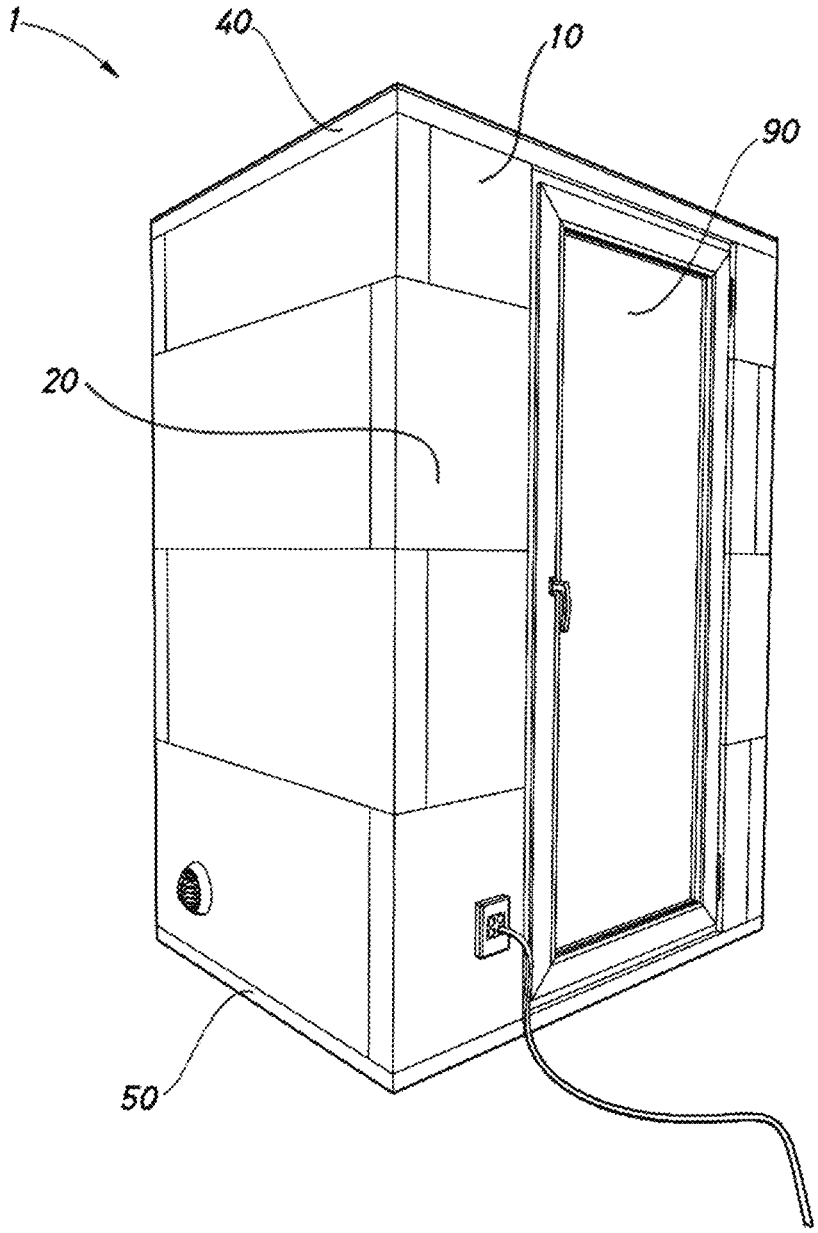
FIG. 4 is a perspective view of a chamber according to the present invention.

FIG. 3 shows a preferred corner arrangement according to the present invention. The panel -20- shown is slightly different to that shown in FIG. 1. In particular, the corner panel -20- shown comprises a layer of sound-attenuating material -14- positioned between two panels -13-, -13'-, i.e. an inside panel -13'- and an outside panel -13-. At least at one end, said layer of sound-attenuating material -14- projects beyond the inside panel -13'-, and the outside panel -13-, by means of said end, continues around the edge corresponding to the end of the layer of the sound-attenuating material -14- that projects beyond the inside panel -13'- (L-shaped part -131-), in such a way as to produce a space between the end of the outside panel -13- (L-shaped part -131-) and the end of the inside panel -13'-, which space forms a groove in which a batten -15- (as an intermediate with another panel) is housed.

FIG. 3 also shows other preferred features of the present invention for all types of channels and connections. As can be seen, the intermediate strip -16- of the batten -15- is located perpendicularly to the joints -61- between adjacent panels. The panels have protrusions -19- to aid the placement of an upper layer of panels. In the inner portion, a layer of sound-attenuating material -60- has been arranged in the form of self-adhesive strips, for example. Preferably, said material strips are arranged such that they cover the entire surface of the panels and such that the joints -61'- between strips do not match with the joints -61- between panels.

The panels in the example can be made of a lignite material, e.g. medium density fibreboard or MDF. The sound-insulating material can for example, be flexible polyurethane foam containing acoustic additives. The length -B- can, for example, be 42 mm and -A- can be 43 mm; the width of -16- can preferably be between 20 and 10 mm.

FIG. 4 to 15 show an example acoustic chamber -1- according to the present invention and an assembly method, showing internal elements. Elements that are identical or similar to those in the previous figures have been identified using the same numerals, and so will not be described in detail. To provide a clear explanation, certain details that can be readily added by a person skilled in the art according to any of the known techniques have not been illustrated. Other details shown have not been explained for similar reasons. For example, the core of one of the panels forming the side walls of the chamber can be replaced by a window.

The chamber shown has a floor -50-, a ceiling -40- and side walls defined by planar panels -10- and panels -20- in the shape of a corner. The side walls leave a space open for accessing the surrounding area, which space is occupied by a door -90-. The internal walls are cladded in a sound-insulating material -60- (see FIGS. 12 and 13), such as wool or foam, which is connected to the internal faces of the panels -10-, -20- by any known method (for example Velcro, self-gluing, gluing, any type of mechanical connection, etc.).

As can be seen in the figures, the panels -10-, -20- have easy-to-handle dimensions. Nonetheless, the aim was also to minimise the number of joints between panels. The aim was also to ensure that the joints between panels were offset between layers, so as to prevent joints that pass through more than one layer of panels. The panels -10-, -20- shown are quadrangular, but could be of a different shape. It can also be seen that there are no actuable mechanical connectors for securing the connection between panels on either the inside face or the outside face of the chamber -1-.

Figure 5:
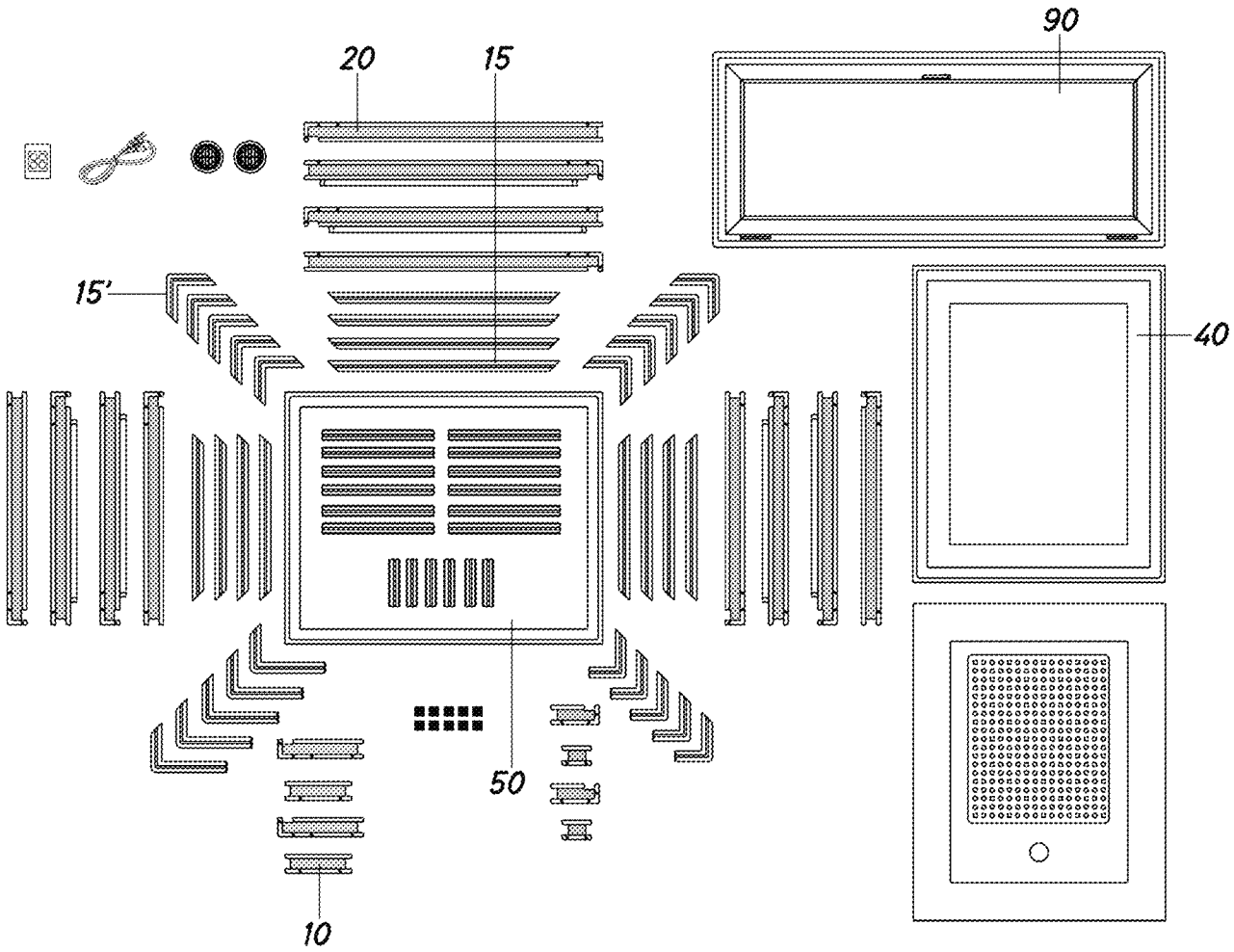
FIG. 5 is an exploded view of some of the elements that form the chamber from FIG. 4.
Figure 6:
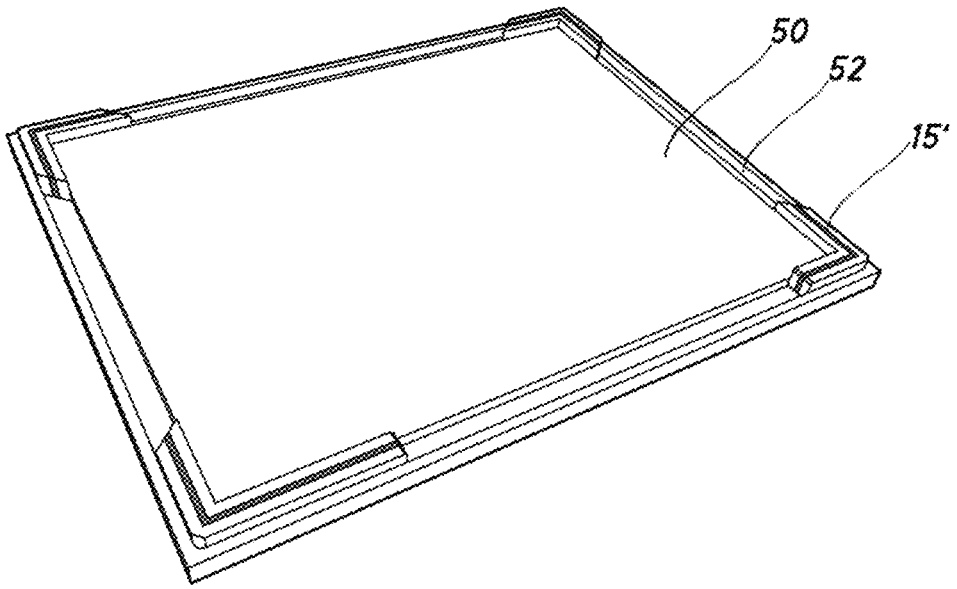
FIG. 6 to 15 are perspective views of a method for assembling the chamber from FIG. 4.
Figure 7:
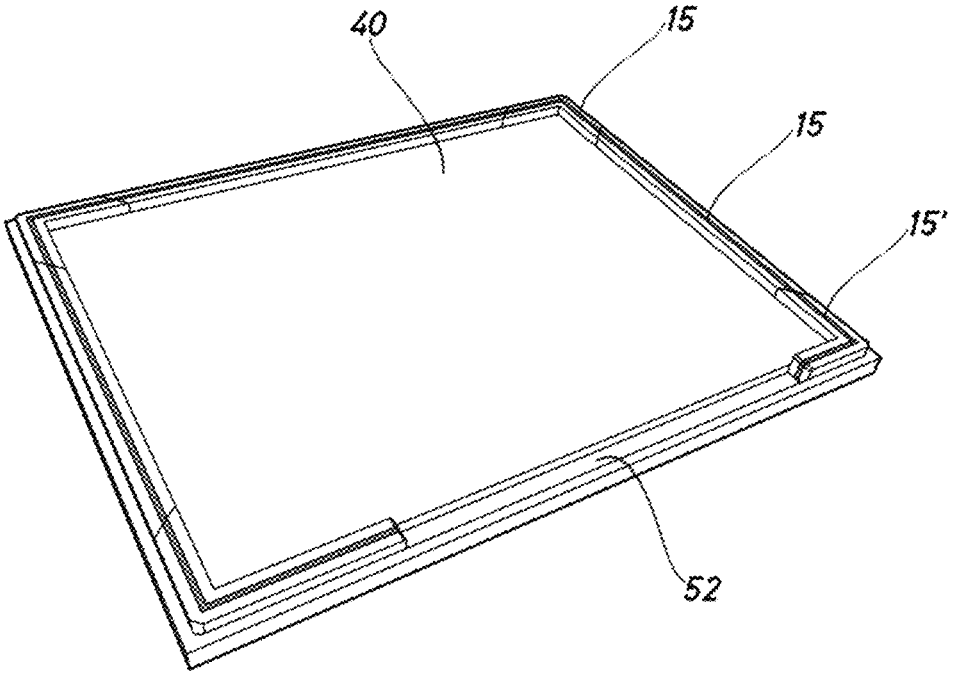
Figure 8:
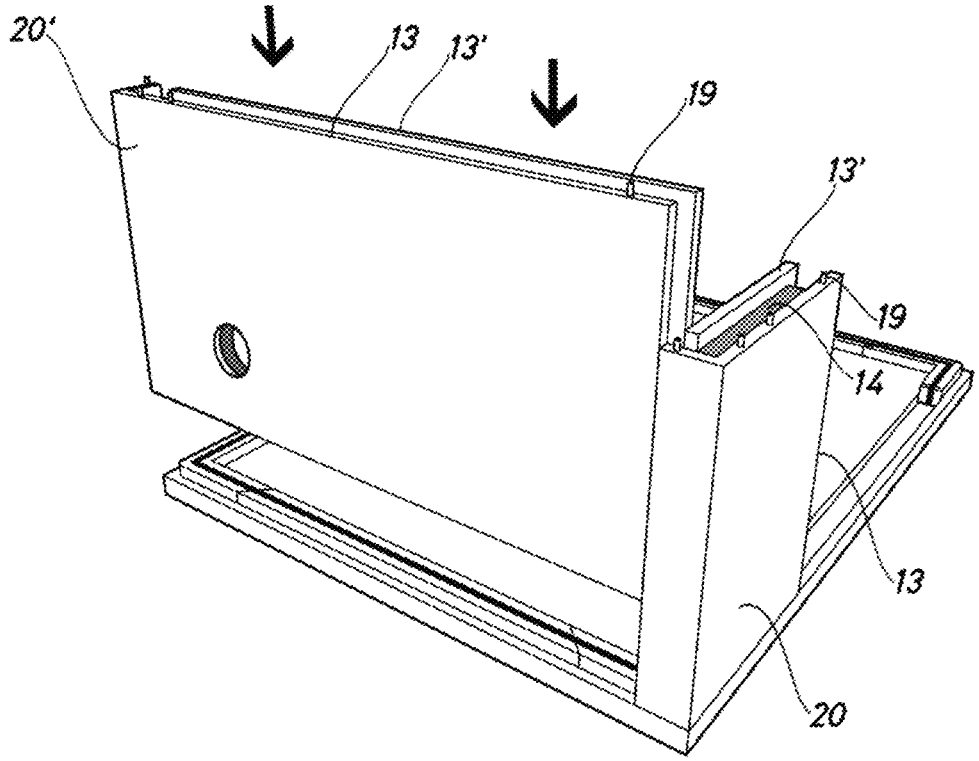
Figure 9:
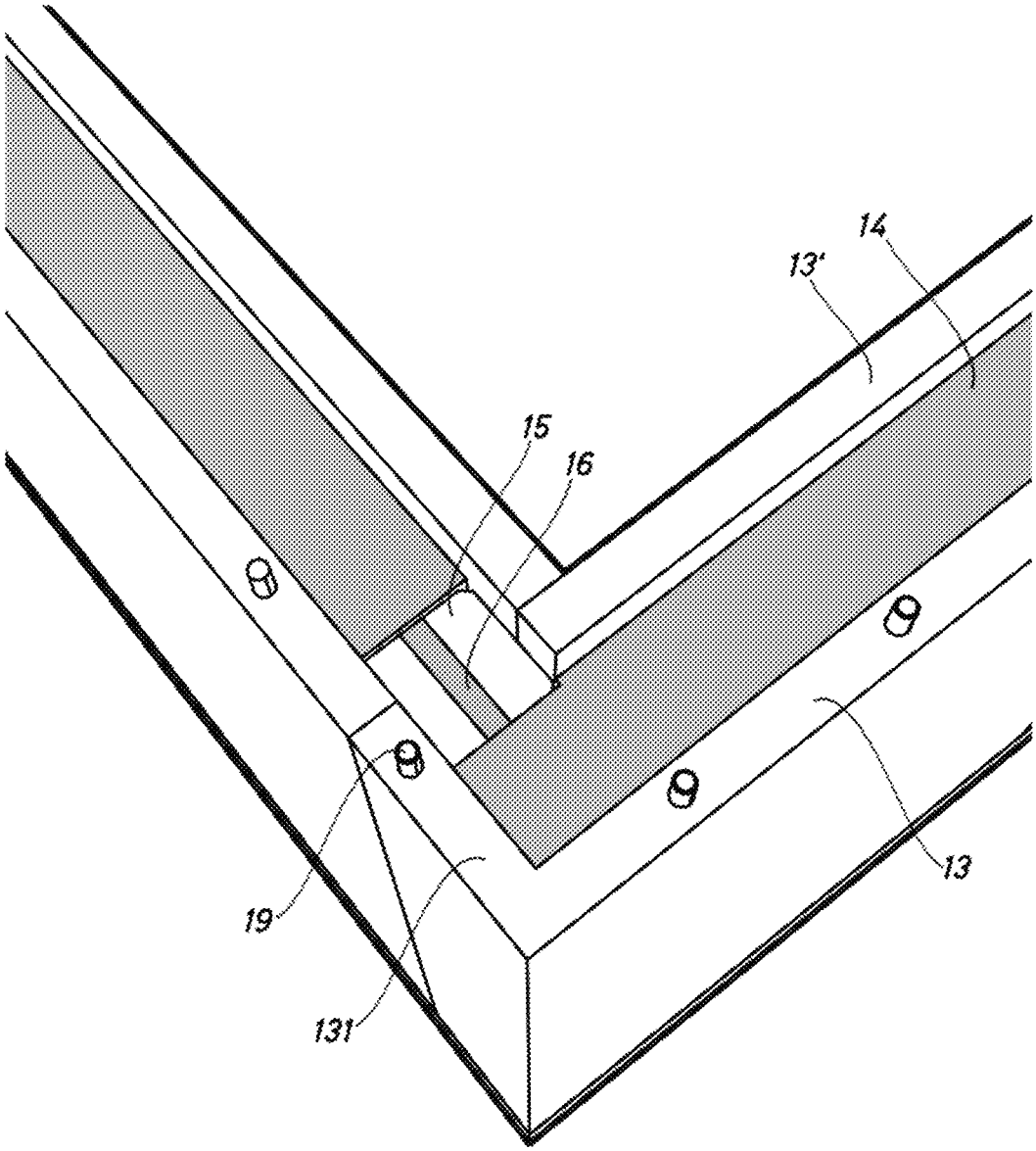
Figure 10:
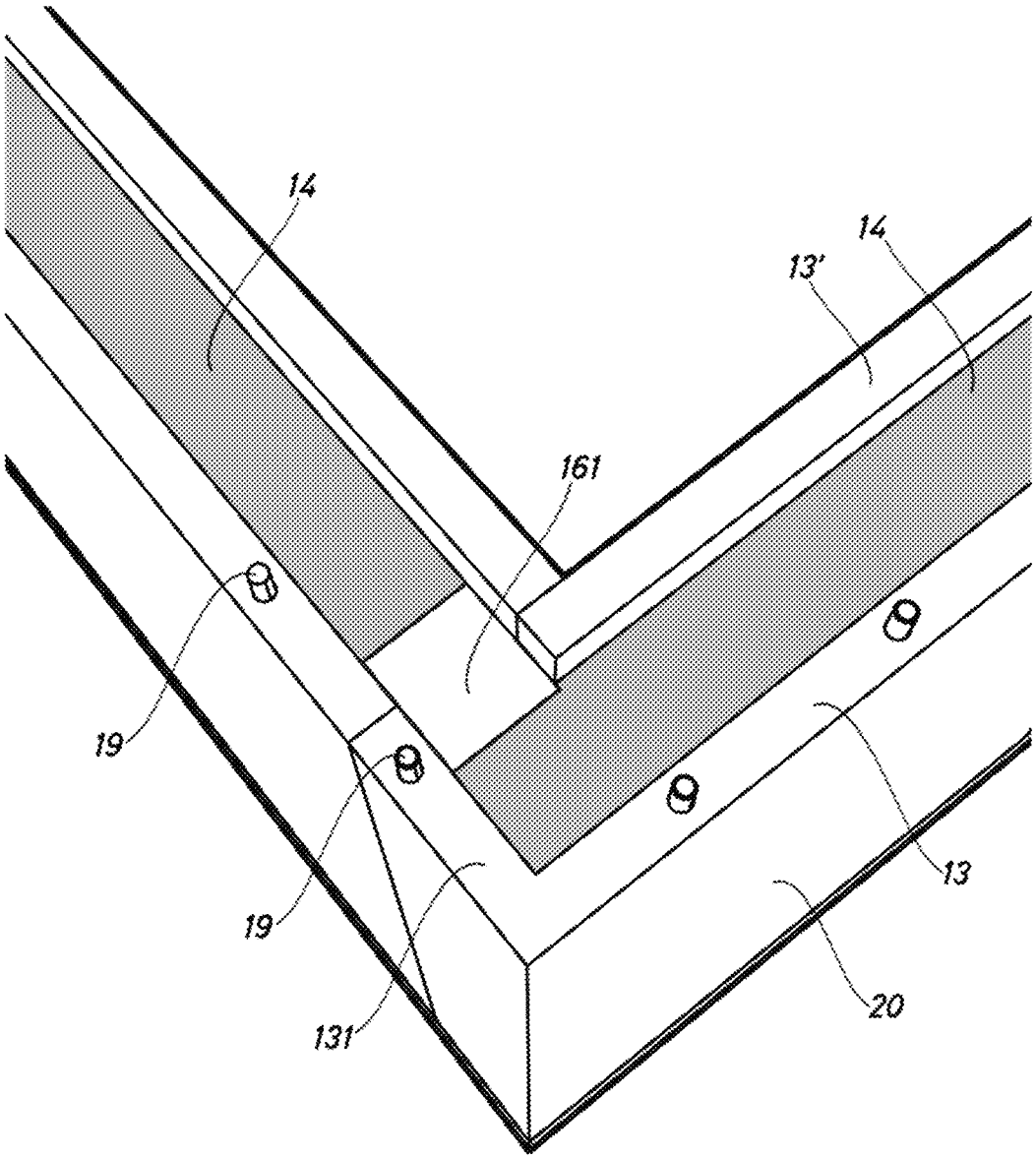
Figure 11:
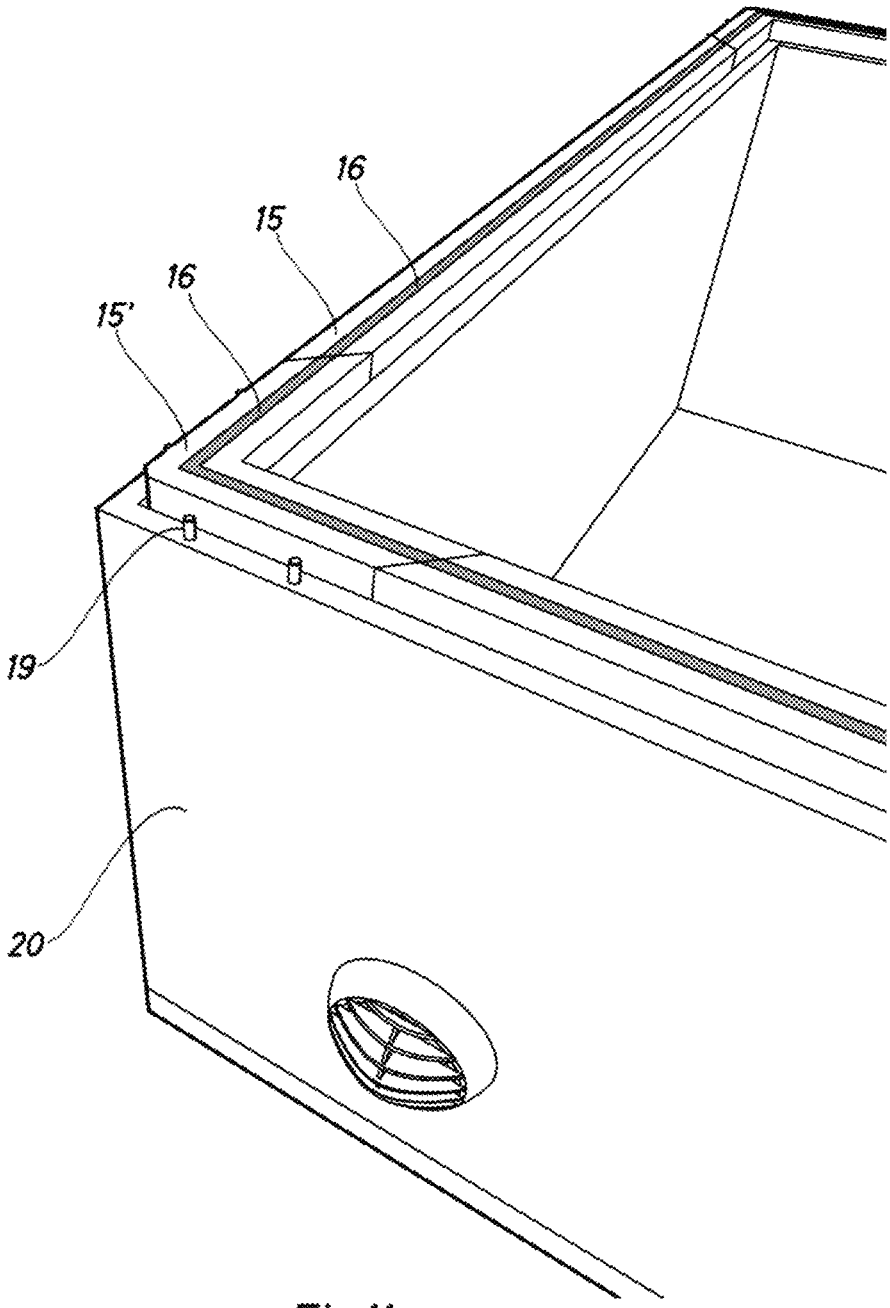
Figure 12:
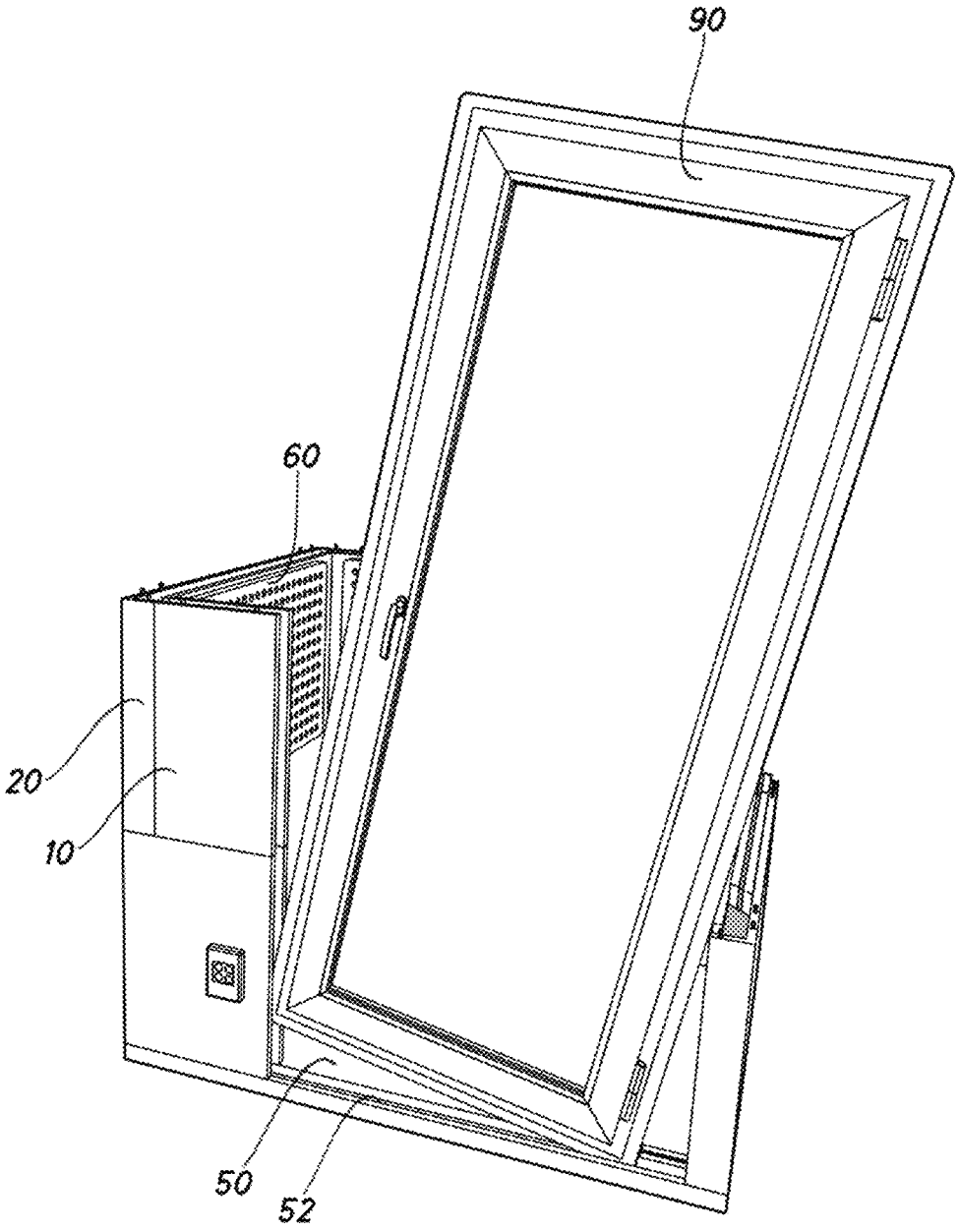
Figure 13:
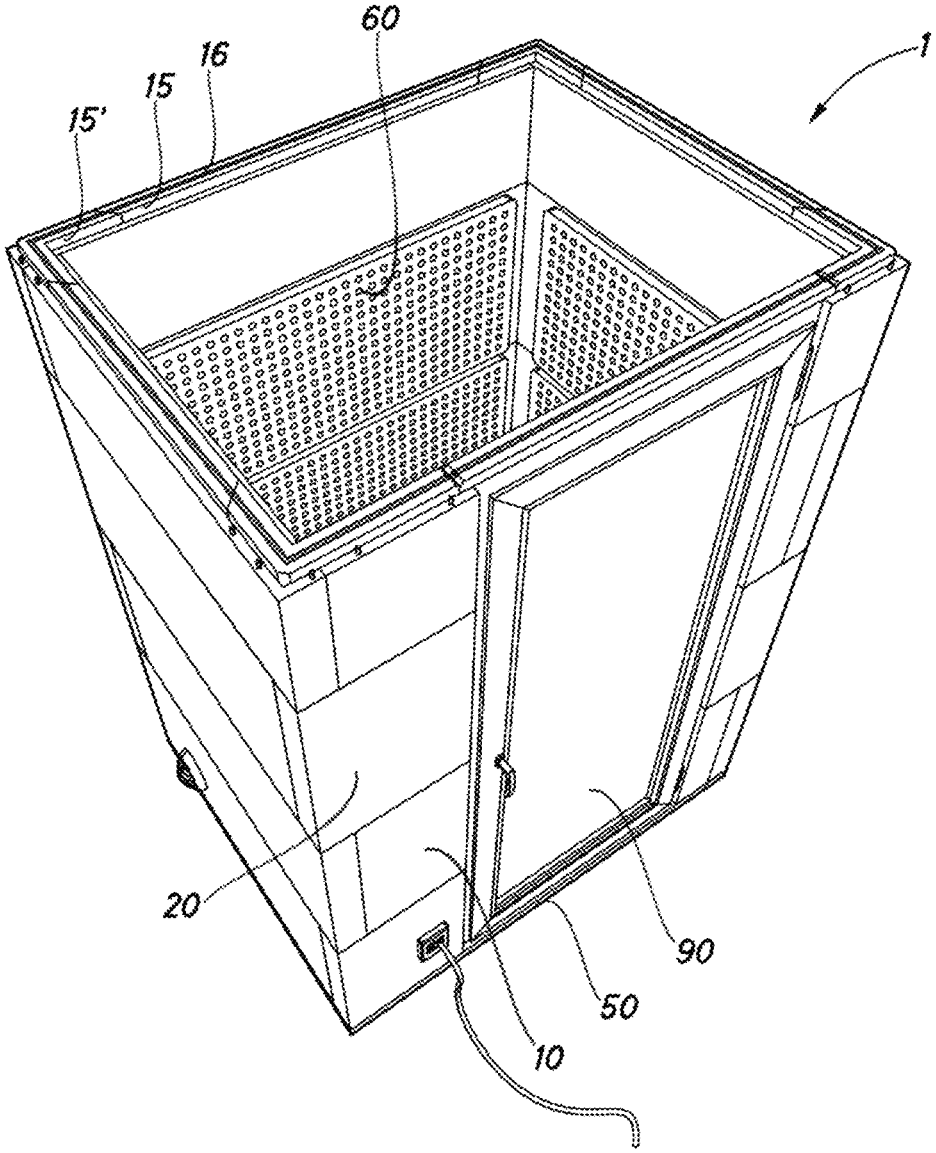
Figure 14:
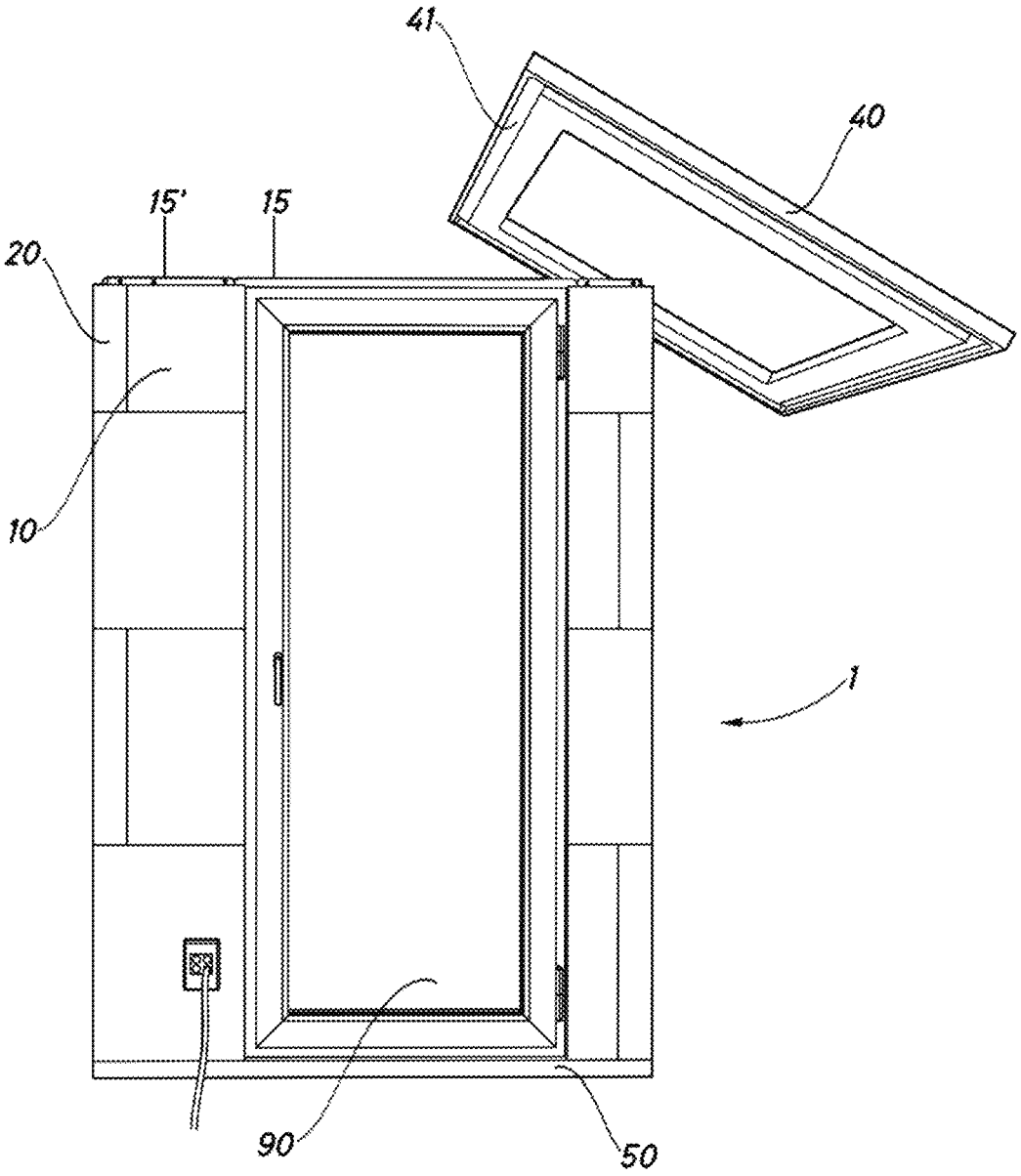
Figure 15:
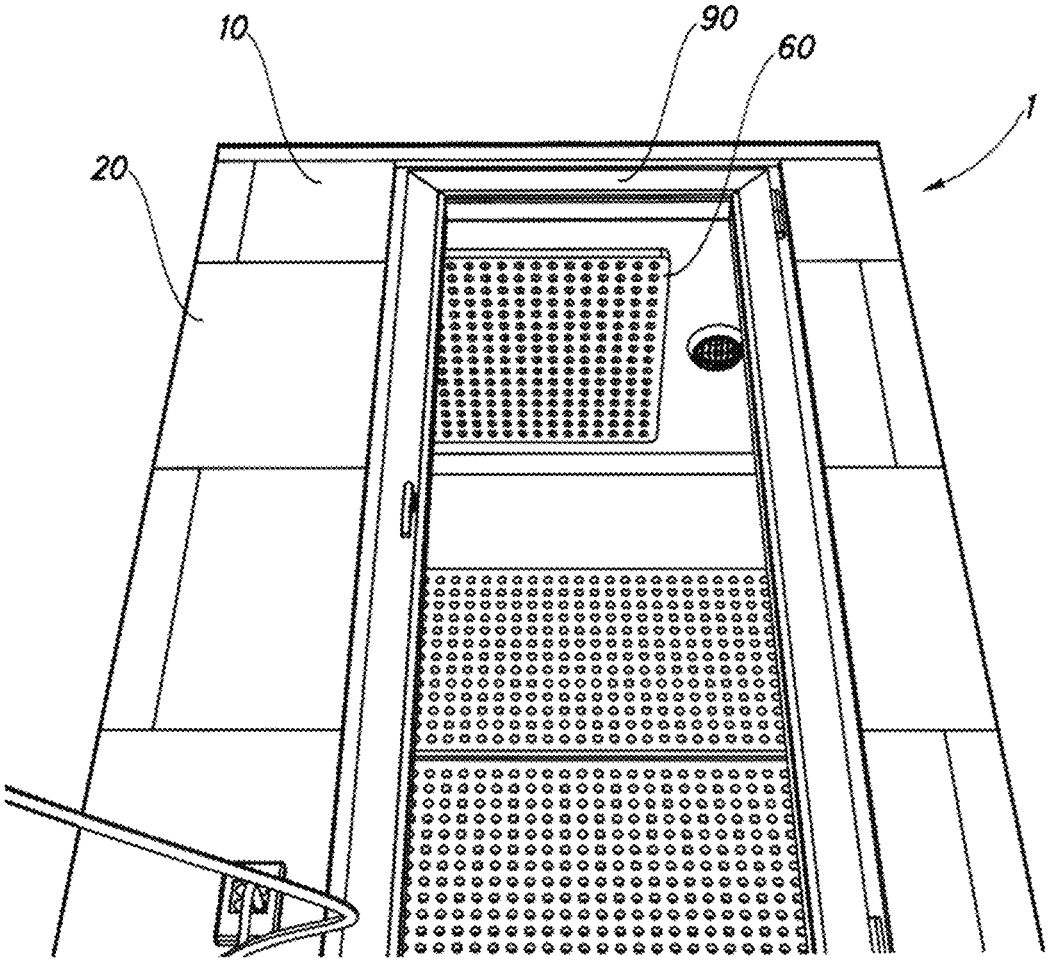

FIG. 5 shows different elements that define the anechoic chamber in the example. Straight panels -10- and corner panels -20- can be seen. Straight battens -15- and battens -15'- in the shape of a corner (intended for the corners) can also be seen. The straight battens intended for being placed vertically have end faces that are perpendicular to the main length of said battens, while the straight battens intended for being placed horizontally have chamfered end faces, i.e. which form an angle other than a right angle with respect to the main direction of the batten. It is preferable for said angle to be 45°, which also aids the placement of the batten. Some panels already have the aforementioned inner covering of acoustic material -60- before being put in position, while others do not. This is to aid quick installation.

For special panels (for example for connection to doors), the panels can have a special rim designed for its specific purpose.

FIG. 6 to 15 show a method for installing the chamber. The placement method is very simple, and begins with arranging the floor piece -50-, which has a peripheral groove -52- in which the corresponding battens should be placed. It is recommended to begin with the corner battens -15'- (see FIG. 6) and then to place the straight battens -15- (see FIG. 7). Next, the panels -20-, -20'- are placed on the battens already in position (see FIG. 8). These battens now have protrusions -19- for aiding the fit of the upper panels (which have matching holes). Together with the panels, the corresponding vertical battens -15- are also arranged (see FIG. 9). The upper portion of these vertical battens is covered with a layer of damping material -161- (see FIG. 10), which can be a sound-insulating material or a material having elastomer properties and the function of which is to prevent vertical vibrations from causing the chamber to generate its own noise. Next, a new layer of horizontal battens -15- and -15'- is put in position, in a similar way to the process for the floor (see FIG. 11). This step is repeated for each layer of panels required. The door -90- to be put in position is also connected to the groove in the adjacent panels (see FIG. 12). Finally, the ceiling piece is pressed in position (see FIGS. 13 and 14) and the missing internal insulation -60- is put in position (see FIG. 15).

Many variants of the example shown are possible. In particular, all the individual, specific features of the example shown can be implemented separately from the rest of the features shown.

Although the invention has been described in terms of preferred embodiments, these should not be taken as limiting the invention, which will be defined by the broadest interpretation of the following claims.

What is claimed is:

1. A dismantlable anechoic chamber for sound attenuation, comprising:

a plurality of interconnected panels, a plurality of battens, which comprise straight battens, corner battens having L-shape, and vertical battens, a groove around edges of the panels, spaces produced by the corresponding grooves at contacting edges of adjacent panels configured to be occupied by the vertical battens, and wherein the panels have a sandwich-type structure in which a layer of sound-attenuating material is positioned between two main faces of the panel and there being dimensional interference between the plurality of battens and the panels, wherein the chamber has, on its internal face, an additional sound-attenuating layer, wherein the sound-attenuating material of the panels is a foam material and each batten has an intermediate layer of sound-attenuating foam material, and wherein the spaces are configured such that each intermediate layer of sound-attenuating foam material of the occupied vertical battens contacts the sound-attenuating material of the adjacent panels.

2. The chamber according to claim 1, wherein the thickness of the layer of sound-attenuating foam material of the batten is less than the thickness of said layer of sound-attenuating material of the panels.

3. The chamber according to claim 2, wherein the thickness of the layer of acoustic material of the plurality of batten is at least 7 mm less than the thickness of said layer of acoustic material of the panels.

4. The chamber according to claim 3, wherein said thickness is at least 10 mm less than said layer of sound-attenuating material of the panels.

5. The chamber according to claim 4, wherein said thickness is at least 20 mm less.

6. The chamber according to claim 1, wherein the sound-attenuating material of both the panels and the plurality of battens is the same.

7. The chamber according to claim 1, wherein said sound-attenuating materials of the panels and the plurality of battens are a pre-pressed sound-attenuating foam material.

8. The chamber according to claim 1 further comprising damping layers between the vertical battens.

9. The chamber according to claim 1 further comprising at least one corner panel, which comprises a layer of sound-attenuating material positioned between an inside panel and an outside panel, said corner panel being such that, at least at one end, said layer projects beyond the inside panel, and the outside panel continues around the corresponding edge at the end of the layer that projects beyond the inside panel, in such a way that a space is produced between the end of the outside panel and the end of the inside panel, which space forms a groove for receiving one of said vertical battens.

* * * * *